US010837707B2

(12) United States Patent
Hakamata et al.

(10) Patent No.: US 10,837,707 B2
(45) Date of Patent: Nov. 17, 2020

(54) HEAT EXCHANGER

(71) Applicant: DENSO CORPORATION, Kariya (JP)

(72) Inventors: Osamu Hakamata, Kariya (JP); Steven Maloney, Kariya (JP); Masaya Nakamura, Kariya (JP)

(73) Assignee: DENSO CORPORATION, Kariya (JP)

( * ) Notice: Subject to any disclaimer, the term of this patent is extended or adjusted under 35 U.S.C. 154(b) by 202 days.

(21) Appl. No.: 16/095,222

(22) PCT Filed: Mar. 6, 2017

(86) PCT No.: PCT/JP2017/008698
§ 371 (c)(1),
(2) Date: Oct. 19, 2018

(87) PCT Pub. No.: WO2017/183331
PCT Pub. Date: Oct. 26, 2017

(65) Prior Publication Data

US 2019/0137184 A1 May 9, 2019

(30) Foreign Application Priority Data

Apr. 21, 2016 (JP) ..... 2016-085417

(51) Int. Cl.
*F28D 1/053* (2006.01)
*F28F 9/02* (2006.01)

(52) U.S. Cl.
CPC ..... *F28D 1/053* (2013.01); *F28F 9/02* (2013.01)

(58) Field of Classification Search
CPC ..... F28D 1/053; F28F 9/02
See application file for complete search history.

(56) References Cited

U.S. PATENT DOCUMENTS

| | | | | |
|---|---|---|---|---|
| 6,082,439 | A | 7/2000 | Kato et al. | |
| 9,328,966 | B2 * | 5/2016 | Brauning | F28D 1/05366 |
| 9,546,828 | B2 * | 1/2017 | Moreau | B21D 53/08 |
| 10,180,289 | B2 * | 1/2019 | Vanderwees | F28F 3/12 |
| 2007/0012424 | A1 | 1/2007 | Kamiya et al. | |
| 2008/0000626 | A1 | 1/2008 | Sugito et al. | |
| 2008/0047689 | A1 | 2/2008 | Hirose et al. | |
| 2008/0121386 | A1 | 5/2008 | Hakamata et al. | |
| 2011/0000642 | A1 | 1/2011 | Hirose et al. | |

(Continued)

FOREIGN PATENT DOCUMENTS

| | | | |
|---|---|---|---|
| DE | 69716856 | T2 | 8/2003 |
| JP | 2000213889 | A | 8/2000 |

(Continued)

*Primary Examiner* — Ljiljana V. Ciric
(74) *Attorney, Agent, or Firm* — Harness, Dickey & Pierce, P.L.C.

(57) ABSTRACT

A side slit of a core plate of a heat exchanger reaches a sealing surface. The core plate has a rib which is formed on a bottom plate across a protruding portion. The rib communicates to a cavity above the sealing surface. An end slit formed on an end wall of the core plate reaches the sealing surface. A first joining tab is formed between two end slits. The first joining tab is joined to a second joining tab on a reinforce plate. The side slit and the rib enable deformation of the core plate. The end slit enables deformation of the first joining tab in a tilting manner.

20 Claims, 9 Drawing Sheets

(56) References Cited

U.S. PATENT DOCUMENTS

| | | | | |
|---|---|---|---|---|
| 2011/0120671 | A1* | 5/2011 | Brauning | F28F 21/06 165/96 |
| 2013/0333867 | A1* | 12/2013 | Moreau | B21D 39/02 165/164 |
| 2017/0051987 | A1* | 2/2017 | Vanerwees | F28F 9/02 |

FOREIGN PATENT DOCUMENTS

| | | | |
|---|---|---|---|
| JP | 2007120827 | A | 5/2007 |
| JP | 2007170747 | A | 7/2007 |
| JP | 2008002723 | A | 1/2008 |
| JP | 2008116101 | A | 5/2008 |
| JP | 2008132572 | A | 6/2008 |
| JP | 4984813 | B2 | 7/2012 |

* cited by examiner

HEAT EXCHANGER

CROSS REFERENCE TO RELATED APPLICATIONS

This application is a U.S. National Phase Application under 35 U.S.C. 371 of International Application No. PCT/JP2017/008698 filed on Mar. 6, 2017. This application is based on and claims the benefit of priority from Japanese patent application No. 2016-085417 filed on Apr. 21, 2016. The entire disclosures of all of the above applications are incorporated herein by reference.

TECHNICAL FIELD

The disclosure in this specification relates to a heat exchanger in which a plurality of tubes are connected to a tank.

BACKGROUND

Patent Literatures 1 to 4 disclose heat exchangers. The heat exchangers have a plate to which a plurality of tubes are connected. The plate may be called as various names, such as a tube plate or a core plate. In this specification "core plate" is used.

In the heat exchangers, it is known that deformation or breakage of a member or a joined portion may occur due to a difference of expansion or contraction amounts resulting from a temperature difference on members such as a plurality of tubes. Such a phenomenon may be called as a thermal strain.

Patent Literatures 1-3 disclose that the thermal strain may arise on the both ends of the core plate. Further, Patent Literatures 1-3 propose improvements by a configuration of the core plate, or a configuration of a reinforce plate on the end portion. Patent Literature 4 discloses a core plate formed with slit shaped cutouts on corners.

CITATION LIST

Patent Literatures

Patent Literature 1: JP2000-213889A
Patent Literature 2: JP2008-116101A
Patent Literature 3: JP2007-120827A
Patent Literature 4: JP2008-132572A

SUMMARY

One of demands for the heat exchanger is to demonstrate higher durability against the thermal strain. For example, in a system with a large temperature change of a medium, and a system with a large amount change of a medium, a large temperature difference may arise in a heat exchanger. In such a viewpoint, the conventional technique does not provide sufficient counter measure against the thermal strain. In the above viewpoint, or in the other viewpoint not mentioned above, further improvement of a heat exchanger is still demanded.

It is an object of disclosure to provide a heat exchanger in which the thermal strain is suppressed.

A heat exchanger in this disclosure comprises: a core plate long and narrow in a longitudinal direction; a plurality of tubes having ends joined to the core plate; and a reinforce plate joined to the core plate at a joined portion disposed on an end of the core plate. The core plate includes: a bottom plate where the plurality of tubes are joined; a side wall which extends from the bottom plate and spreads along the longitudinal direction; and a side deformable portion which is formed on the side wall to extend along a height direction of the side wall from the edge of the side wall, and which is positioned within an end region between the joined portion and a first tube, and which makes deformation of the core plate possible.

According to the heat exchanger in this disclosure, the side deformable portion makes deformation of the core plate possible within the end region between the joined portion and the first tube. A difference of expansion or contraction amounts may arise resulting from a temperature difference between the plurality of tubes and the reinforce plate. In this case, the side deformable portion suppresses strain in the joined portion of the core plate and the tube by facilitating deformation of the core plate.

A heat exchanger in this disclosure comprises: a core plate long and narrow in a longitudinal direction; a plurality of tubes having ends joined to the core plate; and a reinforce plate joined to the core plate at a joined portion disposed on an end of the core plate. The core plate includes: a bottom plate where the plurality of tubes are joined; a protruding portion formed on the bottom plate for receiving the plurality of tubes and for joining with the plurality of tubes; and a rib which is formed on the bottom plate to extends across the protruding portion along a width direction of the core plate, and which is positioned within the end region between the joined portion and the first tube, and which communicates with a cavity defined above a sealing surface which contacts the seal member arranged between the core plate and a tank cover via a side opening in the width direction.

According to the heat exchanger in this disclosure, the rib makes deformation of the core plate possible within the end region between the joined portion and the first tube. A difference of expansion or contraction amounts may arise resulting from a temperature difference between the plurality of tubes and the reinforce plate. In this case, the rib suppresses strain in the joined portion of the core plate and the tube by facilitating deformation of the core plate.

A heat exchanger in this disclosure comprises: a core plate long and narrow in a longitudinal direction; a plurality of tubes having ends joined to the core plate; and a reinforce plate joined to the core plate at a joined portion disposed on an end of the core plate. The core plate includes: a bottom plate where the plurality of tubes are joined; an end wall which extends from the bottom plate, is positioned on an end of the core plate, and is provided with the joined portion; and end deformable portions which are formed on the end wall to extend from the edge of the end wall along the height direction of the end wall beyond the joined portion at both sides of the joined portion, and which define a joining tab which extends from the bottom plate and has the joined portion, and which make deformation of the joining tab possible.

According to the heat exchanger in this disclosure, an end deformable portion makes possible deformation of the joining tab which provides the joined portion between the core plate and the reinforce plate. A difference of expansion or contraction amounts may arise resulting from a temperature difference between the plurality of tubes and the reinforce plate. In this case, the end deformable portions suppress strain in the joined portion of the core plate and the tube by facilitating deformation of the joining tab.

In order to achieve each object, a plurality of embodiments disclosed in this specification use technical measures different each other. Symbols in parenthesis shown in the above section and in the claim merely show correspondences to elements described in embodiments later mentioned as one example, and are not intended to limit the technical scope of this disclosure. Objects, features, and advantages disclosed in this specification may become clearer by referring to the following descriptions and attached drawings.

DETAILED DESCRIPTION

Figure 1:
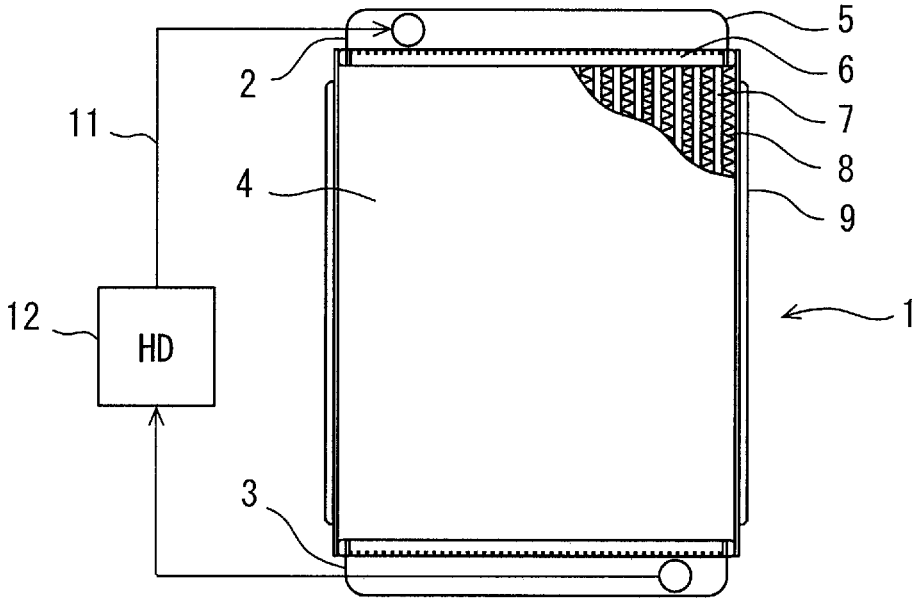
FIG. 1 is a front view of a heat exchanger according to a first embodiment.

A plurality of embodiments are described referring to the drawings. In the embodiments, portions, which may be corresponded and/or associated in functionally and/or structurally, may be indicated by the same reference symbols or reference symbols which merely differs at the first figure of three figures. Description of other embodiment can be referred to for corresponding portions and/or associated portions.

First Embodiment

In FIG. 1, a heat exchanger 1 provides a part of a medium circuit 11 through which a first medium flows in a recirculated manner. The medium circuit 11 has a heat-source device (HD) 12. Thermal energy generated in the heat-source device 12 is carried by the first medium. The heat exchanger 1 defines a passage for passing the first medium. The heat exchanger 1 performs heat exchange between the first medium and a second medium. For example, the heat exchanger 1 is a heat exchanger for vehicle mounted on a vehicle. For example, the heat-source device 12 is a device which requires cooling, such as an internal combustion engine for drive power source of the vehicle, an electric motor for drive power source of the vehicle, and an inverter, etc. For example, the first medium is cooling water. For example, the second medium is air.

The heat exchanger 1 has a pair of tank parts 2 and 3, and a core part 4 disposed between the tank parts 2 and 3. The tank parts 2 and 3 provide a distribution part which distributes the first medium to a plurality of passages, and a collecting part which collects the first medium from the passages. In the illustrated example, the tank part 2 provides an inlet tank. The tank part 3 provides an outlet tank. The core part 4 defines a plurality of passages for the first medium and a plurality of passages for the second medium.

The heat exchanger 1 has a tank cover 5 and a core plate 6 which provide one of the tank parts 2 and 3. The tank cover 5 and the core plate 6 form one of the tank parts 2 and 3 by being connected through a seal member. The core plate 6 has a depression which receives an open end of the tank cover 5, and a plurality of hook portions which are bent to hold the tank cover 5. The tank cover 5 and the core plate 6 are connected by a plurality of hook portions disposed on the edge of the core plate 6. The heat exchanger 1 has two tank covers 5 and two core plates 6.

The heat exchanger 1 has a plurality of tubes 7 and a plurality of outer fins 8 which provide the core part 4. The core plate 6 may be considered as a member forming the core part 4. The plurality of tubes 7 and the plurality of outer fins 8 are arranged to form the core part 4. The tubes 7 are arranged in a row with predetermined intervals. The tubes 7 are arranged in parallel each other along the longitudinal direction of the core plate 6. The passages for the second medium are formed among the tubes 7. The tube 7 forms the passage for the first medium therein. The outer fin 8 is disposed between two adjacent tubes 7. The outer fin 8 contacts on the tube 7. The outer fin 8 is arranged in the passage of the second medium. The outer fin 8 contributes to expand a heat exchange surface area between the tubes 7 and the second medium. The outer fin 8 may also be called as a heat exchange promoting member.

The tubes 7 are connected with the core plate 6. The end of the tube 7 is connected with one core plate 6. The other end of the tube 7 is connected with another core plate 6. The tube 7 and the core plate 6 are connected so that the passage in the tube 7 is communicated with an inside the tank parts 2 and 3. In the illustrated example, the end of the tube 7 is inserted to penetrate the core plate 6.

The heat exchanger 1 has a reinforce plate 9. The heat exchanger 1 has two reinforce plates 9. The reinforce plates 9 are disposed on both ends of the core part 4. The reinforce plate 9 connects two core plates 6. The reinforce plate 9 is connected with the outer fin 8 at the very end. In other words, the outer fin 8 is disposed between the tube 7 and the reinforce plate 9.

The tank cover 5 is made of resin, for example. The core plates 6, the tubes 7, the outer fins 8, and the reinforce plates 9 are metal, such as copper or aluminum. The core plates 6, the tubes 7, the outer fins 8, and the reinforce plates 9 are joined by a joining member. The joining member is a brazing material, for example. The tubes 7 are joined to the core plates 6 at the both ends of the tubes 7. The outer fins 8 are joined to at least one of the tubes 7. The reinforce plate 9 is joined to two core plates 6 at the both ends.

Figure 2:
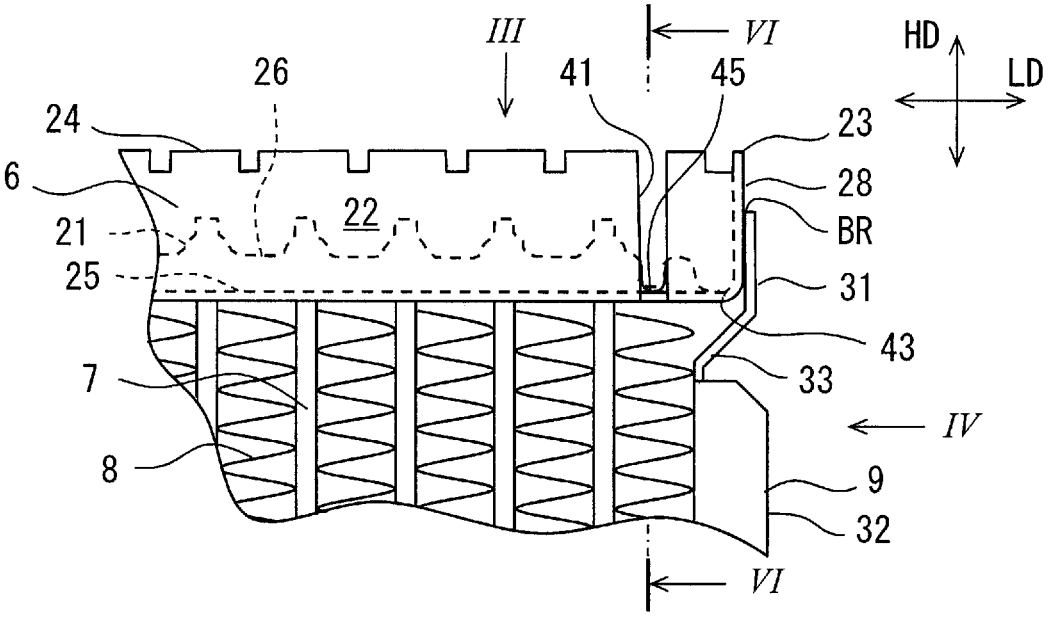
FIG. 2 is a partial enlarged view of the heat exchanger according to the first embodiment.
Figure 3:
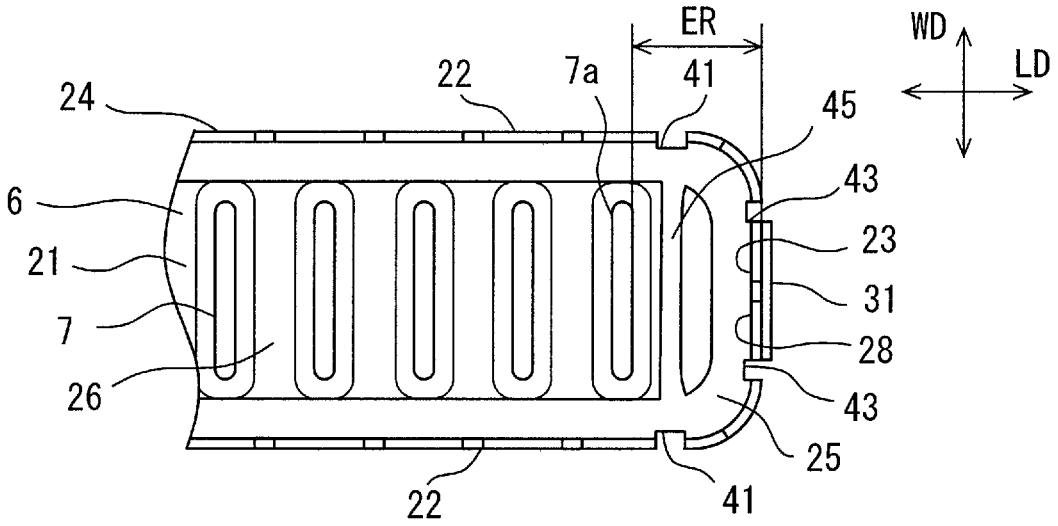
FIG. 3 is a plan view of the heat exchanger according to the first embodiment.
Figure 4:
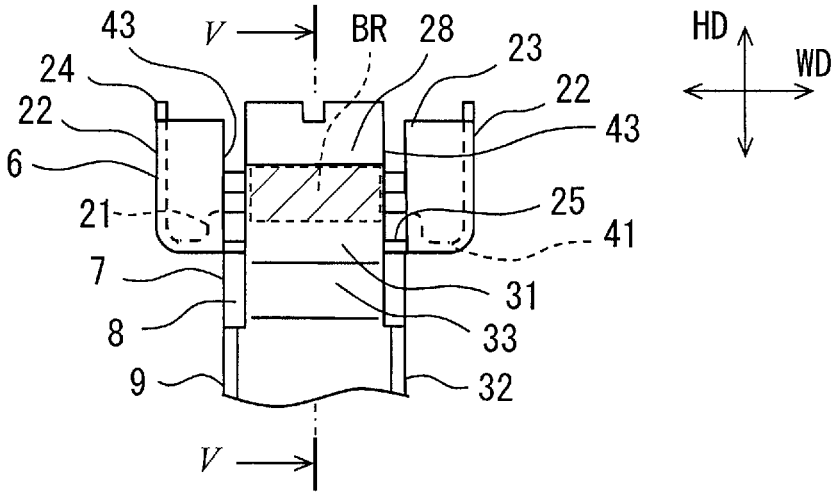
FIG. 4 is a side view of the heat exchanger according to the first embodiment.
Figure 5:
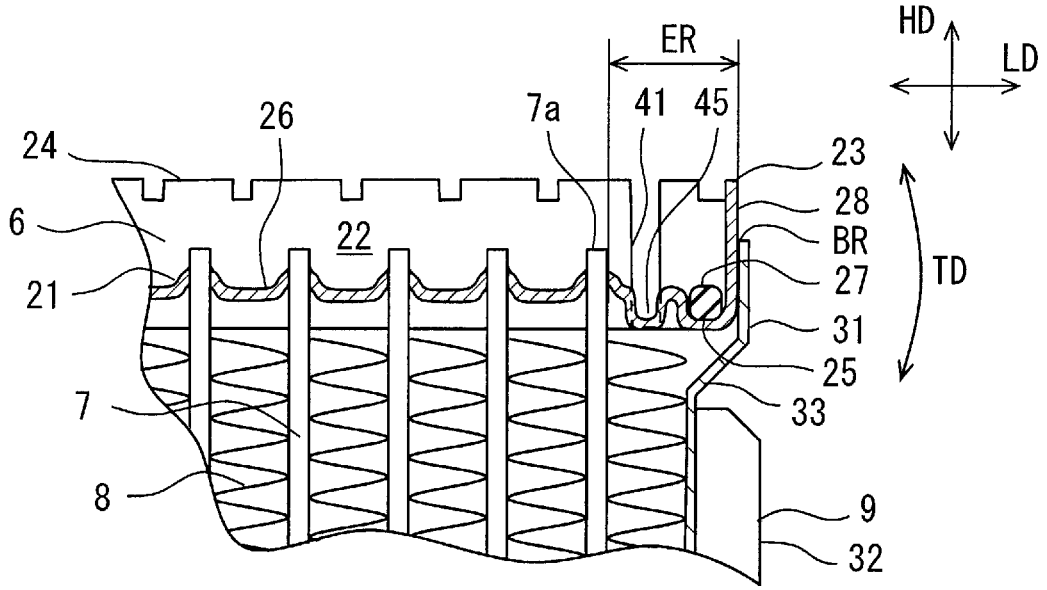
FIG. 5 is a partial cross-sectional view of the heat exchanger according to the first embodiment.
Figure 6:
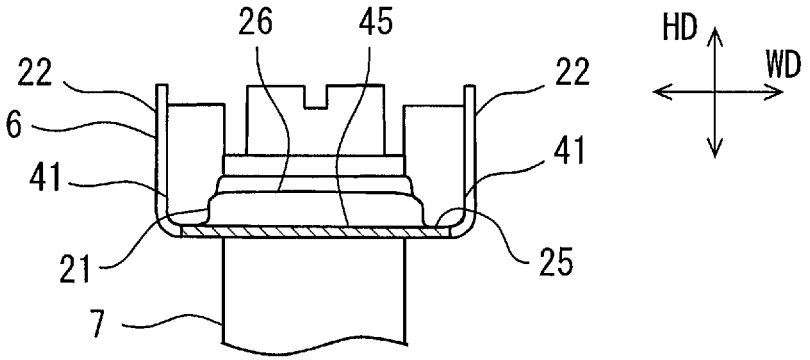
FIG. 6 is a partial cross-sectional view of the heat exchanger according to the first embodiment.

A corner portion of the heat exchanger 1 is illustrated in FIG. 2, FIG. 3, FIG. 4, FIG. 5, and FIG. 6. FIG. 3 is a plan view viewing along an arrow symbol III in FIG. 2. FIG. 4 is a side view viewing along an arrow symbol IV in FIG. 2. FIG. 5 is a cross sectional view at a V-V line in FIG. 4. FIG. 6 is a cross sectional view at a VI-VI line in FIG. 4. In the drawings, depth of the core plate 6 is slightly emphasized.

In the following description, in order to make understanding easy, the top side in FIG. 2 is called an upside, and the bottom side in FIG. 2 is called a downside. A height direction HD corresponds to the longitudinal direction of the tube 7. In many cases, a height indicates the height from the sealing surface 25 to above. The longitudinal direction LD corresponds to a longitudinal direction of the core plate 6. A width direction WD corresponds to a direction perpendicularly intersecting with the longitudinal direction of the core plate 6 (a short hand direction thereof). In many cases, a depth indicates a depth of the indicated portion in an up to down direction, or a down to up direction. Spatial words, such as "up" and "down" do not express the actual condition of the heat exchanger 1.

In FIG. 2 and FIG. 3, the core plate 6 is long and narrow along with the longitudinal direction LD. The core plate 6 is in a shape of a shallow plate. The core plate 6 has a bottom plate 21 in a long and narrow rectangular shape. The core plate 6 has side walls 22 and end walls 23 at least on four sides of the bottom plate 21.

The bottom plate 21 is connected with the plurality of tubes 7. The bottom plate 21 has a plurality of through holes for receiving the tubes 7. The bottom plate 21 is given a configuration suitable to receive the tubes 7. The bottom plate 21 is given a configuration suitable for joining with the tubes 7.

Two side walls 22 are disposed on the long sides of the bottom plate 21. The side wall 22 extends from the bottom plate 21, and spreads along the longitudinal direction LD. Two end walls 23 are disposed on the short sides of the bottom plate 21. The end wall 23 extends from the bottom plate 21. The end wall 23 is located on the end of the core plate 6. Joined portion BR is disposed on the end wall 23. Round corners are formed between the bottom plate 21 and the side wall 22, and between the bottom plate 21 and the end wall 23. Round corners are formed between the side wall 22 and the end wall 23. A plurality of hook portions 24 are formed on the edge of the side walls 22 and the end walls 23. These hook portions 24 are bent to hold the tank cover 5. In the drawings, a configuration before the hook portions 24 are bent is illustrated.

The bottom plate 21 has a sealing surface 25 which extends along with the side walls 22 and the end walls 23. The sealing surface 25 extends annularly along with the side walls 22 and the end walls 23.

In FIG. 5, the seal member 27 is illustrated. The sealing surface 25 contacts the seal member 27. The seal member 27 is arranged along the sealing surface 25. The seal member 27 contacts the sealing surface 25 and contacts the open end of the tank cover 5.

Returning to FIG. 2 and FIG. 3, the bottom plate 21 has a protruding portion 26. The protruding portion 26 protrudes towards inside of the core plate 6. The protruding portion 26 forms, on the bottom plate 21, a configuration suitable for receiving the tubes 7 and for being connected with the tubes 7. The protruding portion 26 provides through holes and depressions for receiving the tubes 7. The protruding portion 26 is formed on the center section of the bottom plate 21. The sealing surface 25 extends to surround the protruding portion 26.

The end wall 23 provides a first joining tab 28 which is joined with the reinforce plate 9. The first joining tab 28 directly continues to the bottom plate 21. The first joining tab 28 is a plate piece which extends from the bottom plate 21.

The reinforce plate 9 is joined to the core plate 6 at a joined portion BR disposed on the end portion of the core plate 6. The reinforce plate 9 has a second joining tab 31 joined to the end wall 23 or the first joining tab 28. The reinforce plate 9 has the end wall part 32 extending along with the core part 4. The end wall part 32 is formed in a cross-sectional shape of a square bracket. The reinforce plate 9 has a connecting part 33 which connects the second joining tab 31 and the end wall part 32. The connecting part 33 extends to cross the longitudinal direction of the end wall part 32. The connecting part 33 is also an adjusting portion which can adjust a length in the longitudinal direction of the reinforce plate 9.

As shown in FIG. 4, the first joining tab 28 and the second joining tab 31 are joined by a joining member at the joined portion BR. The joined portion BR is positioned to be apart from the bottom plate 21.

In FIG. 2 and FIG. 3, the core plate 6 has a side deformable portion. A pair of side deformable portions is provided by two side slits 41 and 41. The side slits 41 and 41 are disposed on both of the side walls 22 and 22. The side slit 41 is positioned within the end region ER at the end of the core plate 6. In other words, the side slit 41 is positioned in the end region ER, and is also positioned on a flat-surface area of the side wall 22. The end region ER corresponds to a range between the first tube 7*a* from the end and the joined portion BR. A comparatively large distortion arises in a joined portion of the first tube 7*a* and the core plate 6.

The side slit 41 penetrates the side wall 22. The side slit 41 straightly extends in the height direction HD of the side wall 22. The side slit 41 extends from the edge of the side wall 22 and reaches a corner part on a boundary between the bottom plate 21 and the side wall 22. The side slit 41 is a deep slit which extends to reach the sealing surface 25 from the edge of the side wall 22. There is no side wall 22 in the part where the side slit 41 is formed. A width of the side slit 41 is smaller than the width of the end region ER. The side slit 41 is positioned to leave a corner part between the side wall 22 and the end wall 23.

As shown in FIG. 5 and FIG. 6, the side slit 41 divides the side wall 22 in the longitudinal direction LD. The side slit 41 may be also called a dividing slit. As a result, the core plate 6 becomes easy to deform about a bending direction shown by an arrow symbol TD due to the side slit 41. The bending direction of arrow symbol TD is a direction which displaces the end portion of the core plate 6 in the height direction HD with respect to the longitudinal direction LD of the core plate 6. When a large temperature difference arises between a plurality of tubes 7 and the reinforce plate 9, strain may occur between the core plate 6 and the tube 7 resulting from a difference of expansion or contraction amounts between the plurality of tubes 7 and the reinforce plate 9. In this case, the core plate 6 is flexibly deformed at the side slit 41, and suppresses strain between the core plate 6 and the tube 7.

The side deformable portion is formed on the side wall 22 to extend along the height direction HD of the side wall 22 from the edge of the side wall 22. The side deformable portion is positioned within the end region ER between the joined portion BR and the first tube 7*a*. The side deformable portion makes deformation of the core plate 6 possible. The side slit 41 may be also called a deformation facilitating portion which makes deformation in the core plate 6 easy to produce. The side slit 41 makes easy to produce deformation on a line extended in the width direction WD. The side slit 41 may be also called a low rigidity portion which partially lowers the rigidity of the core plate 6. Since the side slit 41 forms a part relatively weak in a mechanical strength on the core plate 6, it may be also called a weak portion.

In FIG. 3 and FIG. 4, the core plate 6 has an end deformable portion. A pair of end deformable portions is provided by two end slits 43 and 43. The end slits 43 and 43 are disposed on the end wall 23. The end slit 43 is disposed on both sides of the first joining tab 28. The end slit 43 defines the first joining tab 28 in the end wall 23. In other words, the first joining tab 28 is formed and defined by the end slit 43. The end slit 43 is disposed on both sides of the joined portion BR.

The end slit 43 penetrates the end wall 23. The end slit 43 straightly extends in the height direction HD of the end wall 23. The end slit 43 extends downwardly from the edge of the end wall 23 beyond the joined portion BR. The end slit 43 extends from the edge of the end wall 23 and reaches a corner part on a boundary between the bottom plate 21 and the end wall 23. The end slit 43 is a deep slit which reaches the sealing surface 25 from the edge of the end wall 23. A width of the end slit 43 is smaller than the width of the first joining tab 28. The end slit 43 is positioned to leave a corner part between the side wall 22 and the end wall 23.

The end slit 43 separates the first joining tab 28 from the end wall 23. As a result, the first joining tab 28 is formed as an independent piece like a tongue piece which extends in the height direction HD from the bottom plate 21. Thereby, the first joining tab 28 is easy to be deformed in the direction of the arrow symbol TD in FIG. 5. In other words, the first joining tab 28 is easy to be deformed in a tilting manner. As a result, the first joining tab 28 is flexibly deformed and suppresses strain between the core plate 6 and the tube 7.

The end deformable portions are formed on the end wall 23 to extend from the edge of the end wall 23 along the height direction HD of the end wall 23 beyond the joined portion BR at both sides of the joined portion BR Two end deformable portions define the first joining tab 28 which extends from the bottom plate 21 and has the joined portion BR. The end deformable portions make deformation of the first joining tab 28 possible in the longitudinal direction LD and the height direction HD, i.e., in a tilting manner. The end slit 43 may also be called a deformation facilitating portion which makes deformation of the first joining tab 28 easy to produce. The end slit 43 makes deformation of the first joining tab 28 in the longitudinal direction LD and the height direction HD possible. The end slit 43 may be also called a low rigidity portion which partially lowers the rigidity of the core plate 6. Since the end slit 43 forms a part relatively weak in a mechanical strength on the core plate 6, it may be also called a weak portion.

In FIG. 3, FIG. 5, and FIG. 6, the core plate 6 has a rib 45. The rib 45 is disposed on the bottom plate 21. The rib 45 is disposed within the protruding portion 26. The rib 45 is in a depressed shape in an inside of the core plate 6. The rib 45 has a U-shaped cross section which opens towards the inside of the core plate 6, i.e., towards an inside of the tank parts 2 and 3. The rib 45 provides a part lower than the protruding portion 26 within an area of the protruding portion 26. The rib 45 extends across the core plate 6 along the width direction WD. The rib 45 extends along the width direction WD which goes to the side wall 22 from the side wall 22. The rib 45 is positioned within a range of the end region ER.

The rib 45 traverses the protruding portion 26. The rib 45 has a top opening in upward direction and side openings in lateral direction. The top opening opens in a long and narrow shape on the protruding portion 26. The side opening opens on side surfaces of the protruding portion 26. A cavity defined in the rib 45 communicates with a cavity defined above the sealing surface 25 via the side openings straightly in the width direction WD. The rib 45 opens to the cavity above the sealing surface 25 at both sides of the protruding portion 26. Both ends of the cavity in the rib 45 communicate the cavity above the sealing surface 25. The seal member 27 and the tank cover 5 are arranged in the cavity above the sealing surface 25.

A bottom of the rib 45 is located on the same height as the sealing surface 25. Therefore, the rib 45 is formed so that the bottom surface of the rib 45 and the sealing surface 25 continue as a flat surface. The rib 45 provides a flat-surface part which does not have any projection like the protruding portion 26 on the bottom plate 21.

As shown in the drawings, the rib 45 divides the protruding portion 26 in the longitudinal direction LD. The rib 45 is also called a dividing rib. As a result, the core plate 6 becomes easy to be deformed in a bending direction shown by an arrow symbol TD due to the rib 45. The core plate 6 is flexibly deformed at the rib 45, and suppresses strain between the core plate 6 and the tube 7.

The rib 45 is formed on the bottom plate 21 to extend across the protruding portion 26 along the width direction WD of the core plate 6. The rib 45 is positioned within the end region ER between the joined portion BR and the first tube 7*a*. The side opening of the rib 45 in the width direction WD is communicated with the cavity defined above the sealing surface 25 where the seal member 27 arranged between the core plate 6 and the tank cover 5 contacts. The rib 45 may be also called a deformation facilitating portion which makes deformation in the core plate 6 easy to produce. Since the rib 45 causes the deformation on the line extended in the width direction WD, it can also be called a line deformation facilitating portion. The rib 45 may be also called a low rigidity portion which partially lowers the rigidity of the core plate 6. Since the rib 45 forms a part relatively weak in a mechanical strength on the core plate 6, it may be also called a weak portion.

As shown in the drawing, the side slit 41 and the rib 45 are positioned within the end region ER. In addition, the side slit 41 and the rib 45 are disposed on the same position in the longitudinal direction LD. Thereby, the core plate 6 is easy to be deformed at the position of the side slit 41 and the rib 45.

According to the embodiment described above, the side slit 41 and the rib 45 are disposed between the joined portion BR and the tube 7*a* which is a first one from the end of the core plate 6. Thereby, the rigidity of the core plate 6 is suppressed at the position of the side slit 41 and the rib 45. Thereby, the core plate 6 can be flexibly deformed at the position of the side slit 41 and the rib 45. Therefore, strain between the core plate 6 and the tube 7 is suppressed. The core plate 6 has the deep end slits 43 and 43 on both sides of the first joining tab 28. Thereby, the first joining tab 28 can be deformed in a tilting manner. Therefore, strain between the core plate 6 and the tube 7 is suppressed.

Second Embodiment

Figure 7:
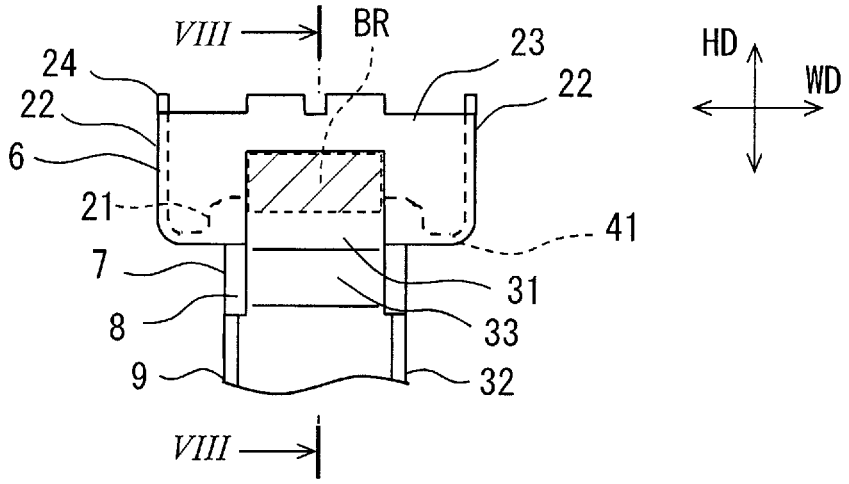
FIG. 7 is a side view of a heat exchanger according to a second embodiment.
Figure 8:
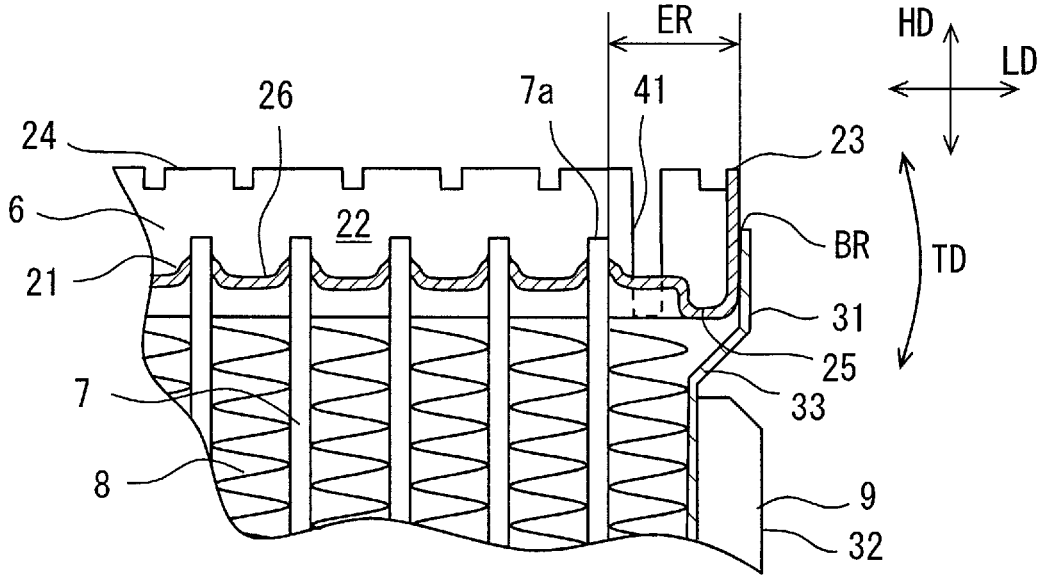
FIG. 8 is a partial cross-sectional view of the heat exchanger according to the second embodiment.

This embodiment is one of modifications based on a basic form provided by the preceding embodiment. FIG. 8 is a cross sectional view at a VIII-VIII line in FIG. 7. In FIG. 7 and FIG. 8, the core plate 6 has the side slit 41. The core plate 6 does not have any end slit 43 and rib 45. In this embodiment, it is also possible to suppress strain between the core plate 6 and the tube 7 by the side slit 41.

Third Embodiment

Figure 9:
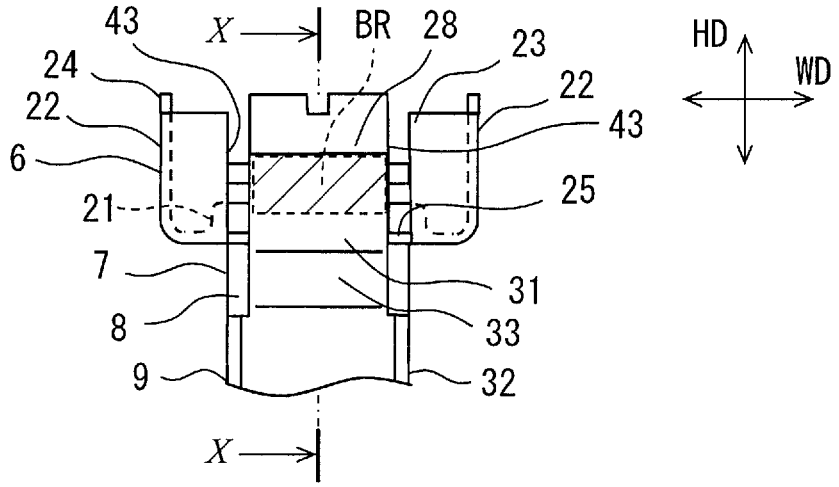
FIG. 9 is a side view of a heat exchanger according to a third embodiment.
Figure 10:
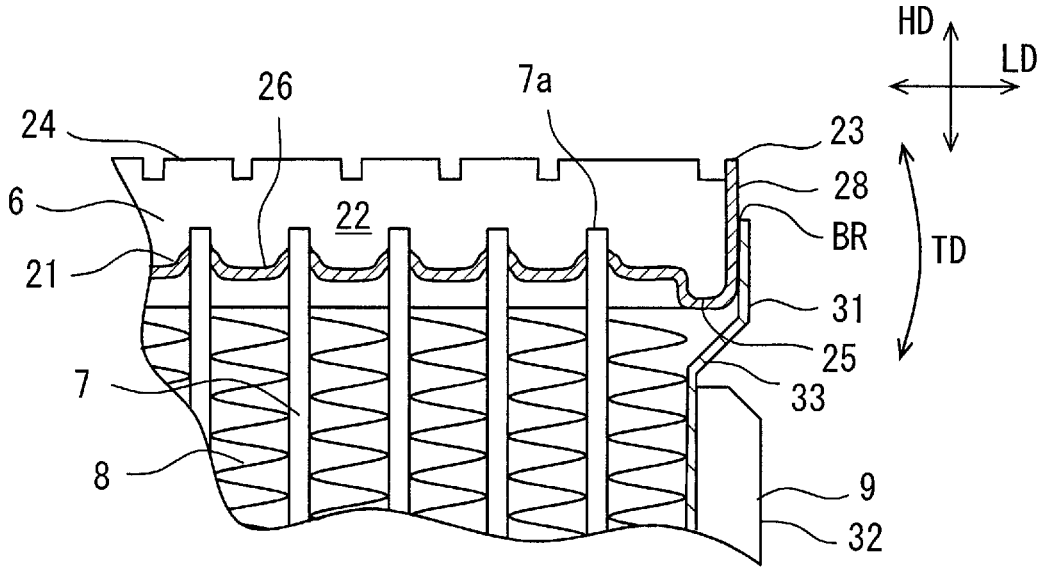
FIG. 10 is a partial cross-sectional view of the heat exchanger according to the third embodiment.

This embodiment is one of modifications based on a basic form provided by the preceding embodiment. FIG. 10 is a cross sectional view at an X-X line in FIG. 9. In FIG. 9 and FIG. 10, the core plate 6 has the end slit 43. The core plate 6 does not have any side slit 41 and rib 45. In this embodiment, it is also possible to suppress strain between the core plate 6 and the tube 7 by the end slit 43.

Fourth Embodiment

Figure 11:
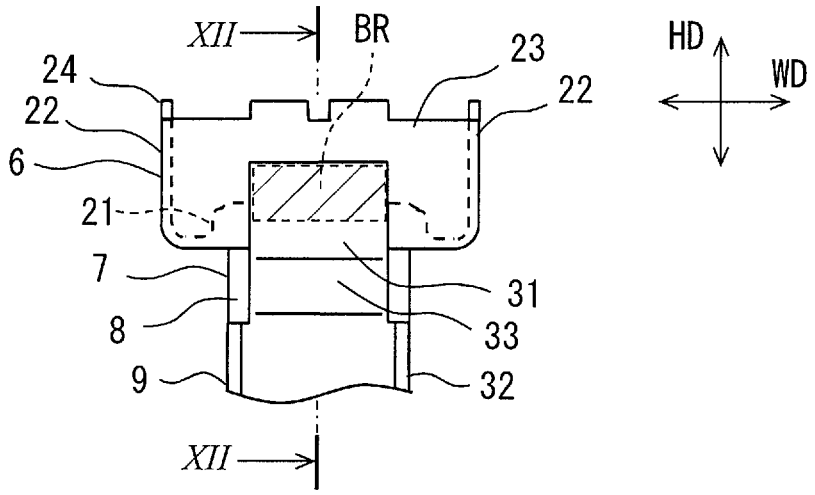
FIG. 11 is a side view of a heat exchanger according to a fourth embodiment.
Figure 12:
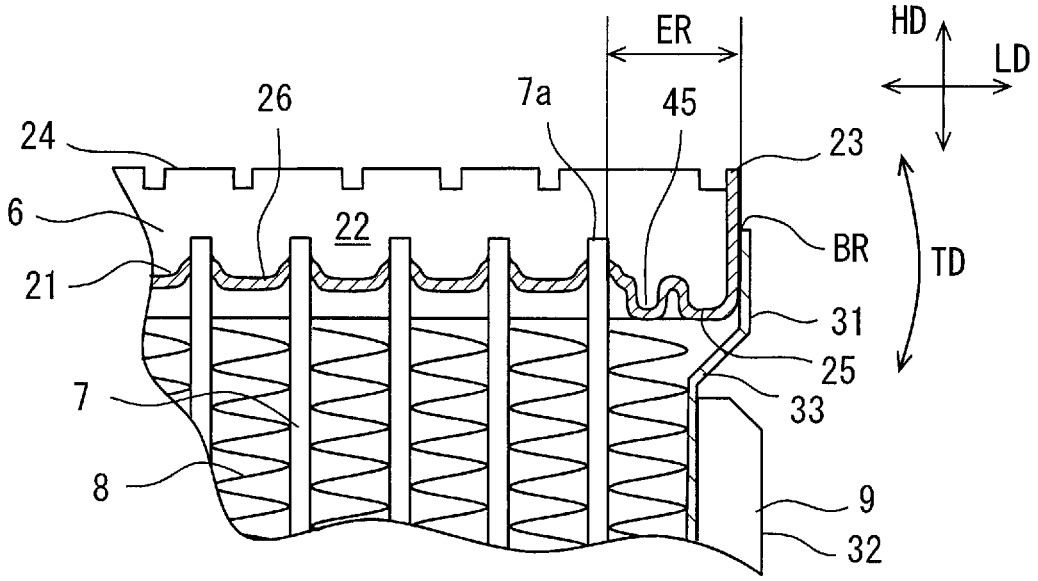
FIG. 12 is a partial cross-sectional view of the heat exchanger according to the fourth embodiment.

This embodiment is one of modifications based on a basic form provided by the preceding embodiment. FIG. 12 is a cross sectional view on a line XII-XII in FIG. 11. In FIG. 11 and FIG. 12, the core plate 6 has the rib 45. The core plate 6 does not have any side slit 41 and end slit 43. In this embodiment, it is also possible to suppress strain between the core plate 6 and the tube 7 by the rib 45.

Fifth Embodiment

This embodiment is one of modifications based on a basic form provided by the preceding embodiment. In the preceding embodiments, the first joining tab 28 is positioned in parallel with the end wall 23. Alternatively, the first joining tab 28 may have various configurations. For example, the first joining tab 28 may have a configuration easier to be deformed independently from the end wall 23.

Figure 13:
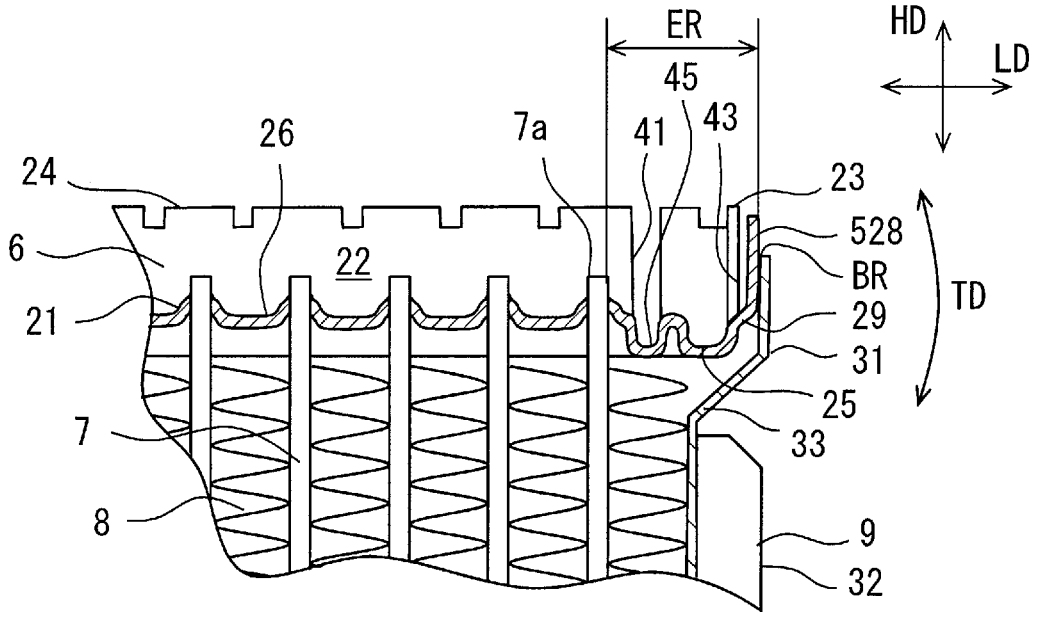
FIG. 13 is a partial cross-sectional view of a heat exchanger according to a fifth embodiment.

In FIG. 13, the core plate 6 has a first joining tab 528. The first joining tab 528 is formed and defined by the end slits 43. The first joining tab 528 has a slant portion 29 between the bottom plate 21 and the joined portion BR. The slant portion 29 positions the first joining tab 528 outside the end wall 23. The slant portion 29 makes the first joining tab 528 easy to be deformed in the direction of arrow symbol TD. The slant portion 29 is also called a deformation facilitating part. According to this embodiment, deformation of the first joining tab 528 is facilitated by the slant portion 29. Therefore, strain between the core plate 6 and the tube 7 is suppressed.

Sixth Embodiment

This embodiment is one of modifications based on a basic form provided by the preceding embodiment. In the preceding embodiments, joining between the first joining tab 28 or 528 and the second joining tab 31 is provided by joining flat plates. Alternatively, various joining configurations may be used. For example, a mechanical engaging which engages mechanically a part of end wall 23 and the reinforce plate 9 and a joining by the joining member may be used in a combined manner.

Figure 14:
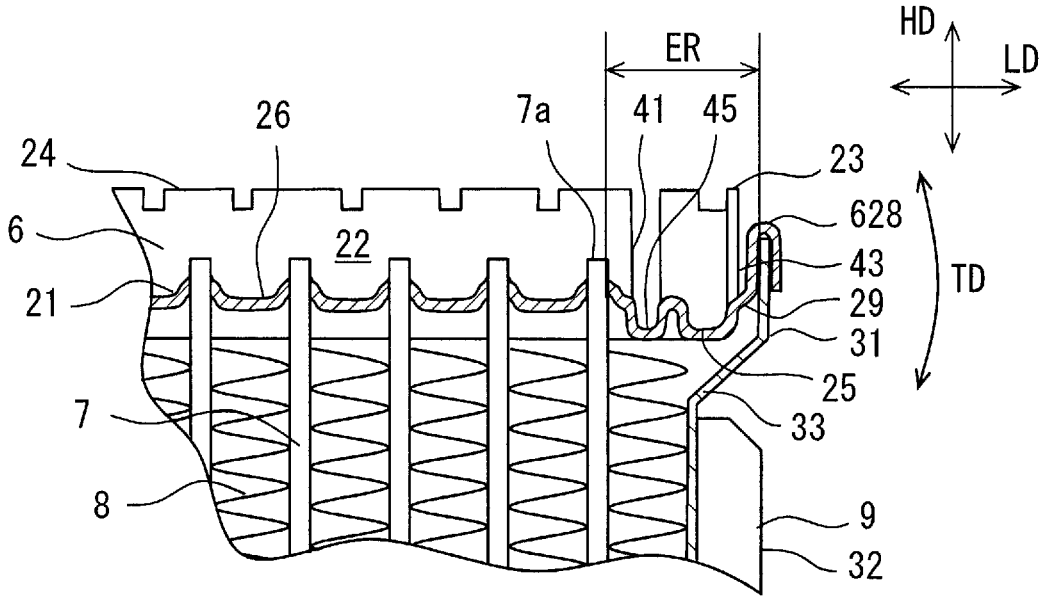
FIG. 14 is a partial cross-sectional view of a heat exchanger according to a sixth embodiment.

In FIG. 14, the core plate 6 has a first joining tab 628. The first joining tab 628 is formed as a clip part which engages with the second joining tab 31 mechanically. The clip part is provided by a part formed in a U shaped cross section which accommodates the second joining tab 31 therein. The clip part is formed by bending the first joining tab 628. The clip part is mechanically meshed with the second joining tab 31. The clip part enables engagement of the first joining tab 628 and the second joining tab 31 before a brazing process. In addition, the joining member joins between the first joining tab 628 and the second joining tab 31. According to this embodiment, it is possible to provide a secure engagement of the core plate 6 and the reinforce plate 9. In addition, it is possible to achieve similar functions and advantages in the preceding embodiments.

Seventh Embodiment

This embodiment is one of modifications based on a basic form provided by the preceding embodiment. In the preceding embodiment, as shown in FIG. 3, the side slit 41 and the end slit 43 reach the sealing surface 25. The bottom surface of the rib 45 also reaches the sealing surface 25. Alternatively, the slits may have a little shallow depth which does not reach the sealing surface 25. The rib may also have a little shallow depth which does not reach the sealing surface 25. FIG. 16 is a cross sectional view on a XVI-XVI line in FIG. 15. FIG. 17 is a cross sectional view on a line XVII-XVII in FIG. 16.

Figure 15:
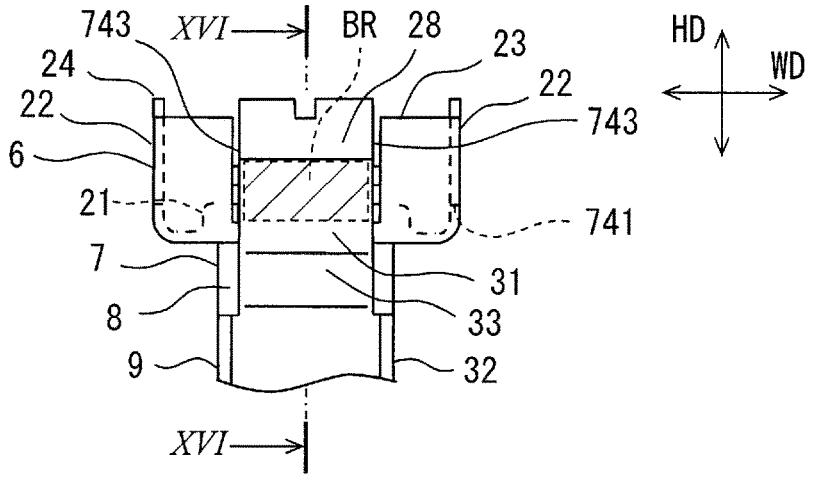
FIG. 15 is a side view of a heat exchanger according to a seventh embodiment.
Figure 16:
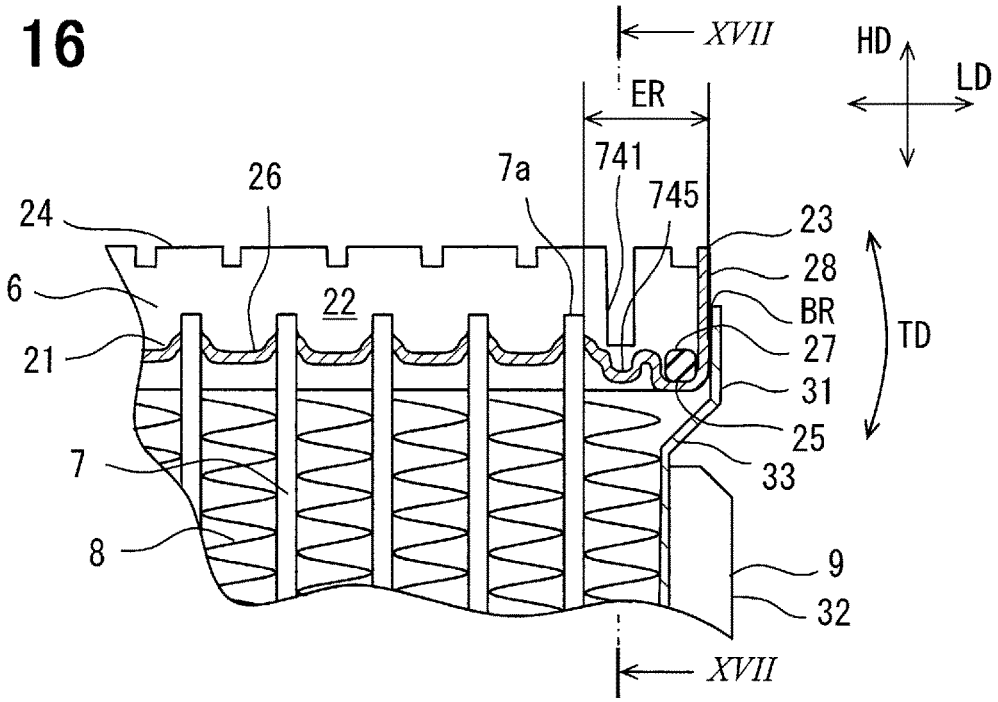
FIG. 16 is a partial cross-sectional view of the heat exchanger according to the seventh embodiment.
Figure 17:
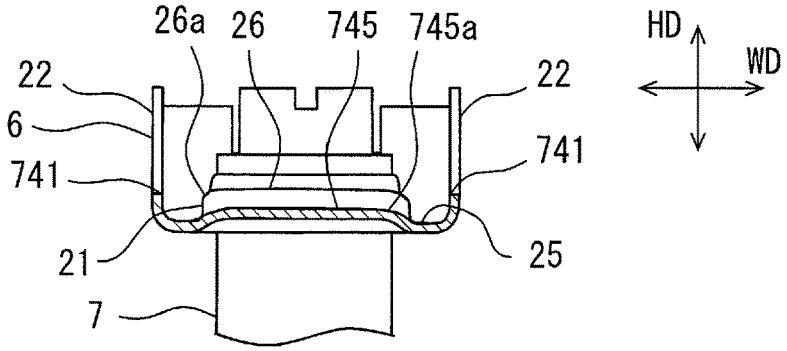
FIG. 17 is a partial cross-sectional view of the heat exchanger according to the seventh embodiment.

In FIG. 15, FIG. 16, and FIG. 17, the core plate 6 has a pair of side slits 741. Depth of the side slit 741 is shallower than the depth of the side slit 41. The side slit 741 has a depth which does not reach a curved portion between the bottom plate 21 and the side wall 22, i.e., the corner portion. The side slit 741 has a depth which is from the edge of the side wall 22 and reaches the height of the protruding portion 26. Although the shallow side slit 741 makes easy deformation of the core plate 6 at the side slit 741, it suppresses deformation of the sealing surface 25 and a gutter for accommodating the seal member 27.

The core plate 6 has an end slit 743. Depth of the end slit 743 is shallower than the depth of the end slit 43. The end slit 743 has a depth which does not reach a curved portion between the bottom plate 21 and the end wall 23, i.e., the corner portion. The end slits 743 have a depth which is from the edge of the end wall 23, passes on the both sides of the joined portion BR, and reaches below the joined portion BR. Width of the end slit 743 is smaller than the width of the end slit 43. Since the width of the end slit 743 does not affect the ease of deformation of the first joining tab 28, it is possible to use comparatively free setting. The end slit 743 suppresses deformation of the sealing surface 25 and the gutter for accommodating the seal member 27, while forming the first joining tab 28 possible to be deformed in a tilting manner.

The core plate 6 has a rib 745. Depth of the rib 745 is shallower than the depth of the rib 45. The bottom portion of the rib 745 does not reach the sealing surface 25. A shoulder portion 745*a*, which protrudes towards the inside of the core plate 6, is formed between both ends of the rib 745 and the sealing surface 25. A curved surface of the shoulder portion 745*a* has a curvature smaller than that of the curved surface of the shoulder portion 26*a* on the protruding portion 26. In other words, the curved surface of the shoulder portion 745*a* is more gently-sloping than the curved surface of the shoulder portion 26*a*. The shoulder portion 745*a* suppresses a deformation of the seal member 27 towards an inside of the rib 745.

The width in the longitudinal direction LD of the side slit 741 is equal to the width in the longitudinal direction LD of the rib 745. In ranges of such width, the core plate 6 tends to be deformed in the direction of arrow symbol TD. Although the rib 745 makes easy deformation of the core plate 6 at the rib 745, it suppresses deformation of the sealing surface 25 and a gutter for accommodating the seal member 27. In this embodiment, it is also possible to suppress strain between the core plate 6 and the tube 7.

Eighth Embodiment

Figure 18:
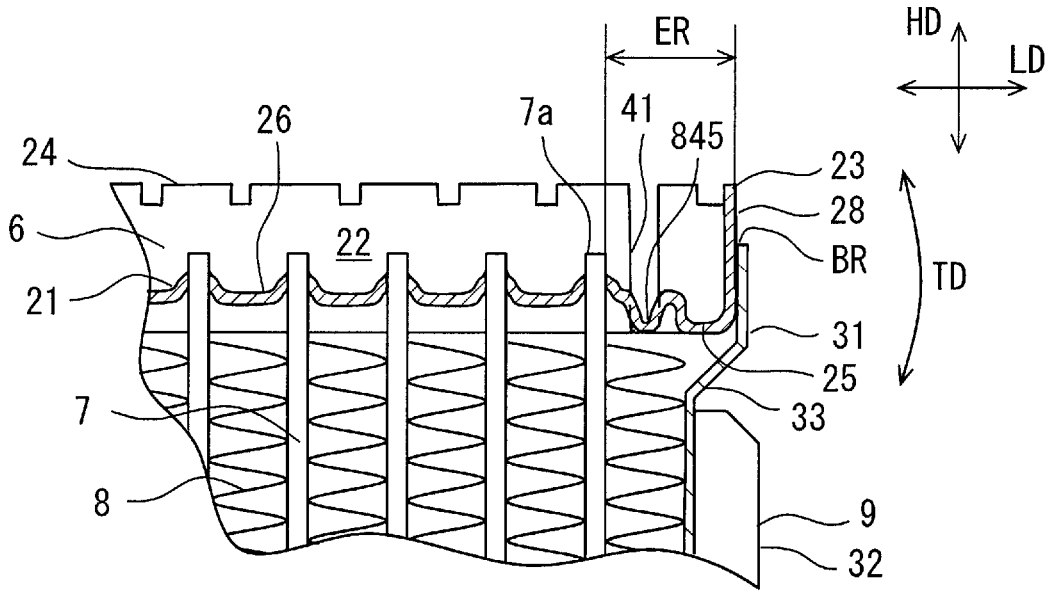
FIG. 18 is a partial cross-sectional view of a heat exchanger according to an eighth embodiment.

This embodiment is one of modifications based on a basic form provided by the preceding embodiment. In the preceding embodiments, the rib 45 has a U shaped cross section. Alternatively, the rib 45 may have various cross sectional shapes. In FIG. 18, the core plate 6 has a rib 845. The rib 845 has a V shaped cross section. The rib 845 can be used by replacing the rib 45 in the preceding embodiments. In this embodiment, it is also possible to suppress strain between the core plate 6 and the tube 7 by the rib 845.

Ninth Embodiment

This embodiment is one of modifications based on a basic form provided by the preceding embodiment. In the preceding embodiments, the side deformable portion is formed by the side slits 41 and 741. Alternatively, the side deformable portion can be provided with various configurations. For example, the side deformable portion can be provided by a plurality of through holes arranged on a line. The side deformable portion can be provided by a curved portion, such as in a U shape and an S shape, formed on the side wall 22.

Figure 19:
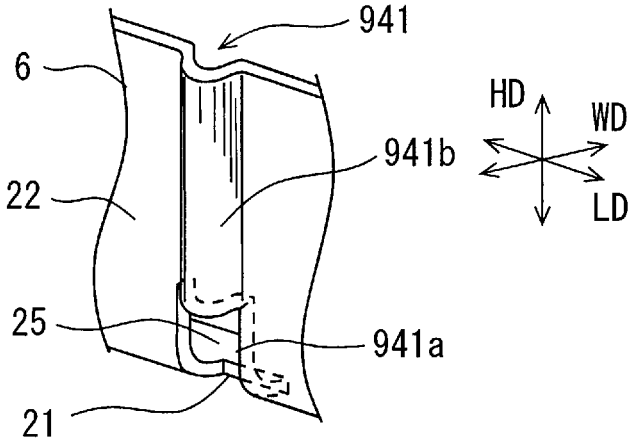
FIG. 19 is a partial perspective view of a heat exchanger according to a ninth embodiment.

FIG. 19 is a perspective view showing the side deformable portion 941. In the drawings, the bottom plate 21 and the side wall 22 in the end region ER are illustrated. The side deformable portion 941 has a through hole 941*a* formed over the bottom plate 21 and the side wall 22. The through hole 941*a* is positioned on a corner portion between the bottom plate 21 and the side wall 22. The side deformable portion 941 has a curved portion 941*b* which extends along the height direction HD from the edge of the side wall 22. The curved portion 941*b* is disposed over the edge and the through hole 941*a*. The curved portion 941*b* forms a ridge and valley extending along the height direction HD. The curved portion 941*b* projects towards the outside of the core plate 6. According to this embodiment, the through hole 941*a* and the curved portion 941*b* make deformation of the core plate 6 possible. Therefore, strain between the core plate 6 and the tube 7 is suppressed.

Other Embodiments

The disclosure in this description is not restricted to the illustrated embodiment. The disclosure includes the illustrated embodiments and modifications by a person skilled in the art based on the illustrated embodiments. For example, disclosure is not limited to the component and/or the combination of the components shown in the embodiments. The disclosure can be carried out with various combinations. The disclosure may use additional parts which can be added to the embodiments. The disclosure may contain modifications in which component and/or element of the embodiments are removed. The disclosure may contain modifications in which component and/or element of the embodiments are exchanged or combined. Technical scope of disclosure is not limited to the embodiments. It should be understood that some disclosed technical scope may be shown by description in the scope of claim, and contain all modifications which are equivalent to and within description of the scope of claim.

In the preceding embodiments, at least one of side slits 41, 741 and ribs 45, 745, 845 is disposed within the end region ER. Alternatively, a plurality of side slits may be disposed as replacements of one side slit 41, 741. Additional slit may be disposed on outside of the end region ER. For example, a slit may be disposed on the side wall 22 in a region where the plurality of tubes 7 are arranged. For example, a rib may be disposed on the bottom plate 21 in a region where the plurality of tubes 7 are arranged. In addition, a group of the side slit 41, 741 and the rib 45, 745, 845 may be additionally disposed on outside of the end region ER.

In the preceding embodiments, a group of the side slit 41, 741 and the rib 45, 745, 845 is arranged in the same position in the longitudinal direction LD of the core plate 6. Alternatively, the side slit 41, 741 and the rib 45, 745, 845, which form a group, may be arranged in a shifted manner in the longitudinal direction LD of the core plate 6.

In the preceding embodiments, the reinforce plate 9 is joined on a lateral outside surface of the core plate 6. Alternatively, the reinforce plate 9 may be inserted in the core plate 6 like the tube 7, and may be connected mechanically and/or may be brazed.

In the preceding embodiments, the side slit 41, 741 and the end slit 43, 743 are provided by straight linear shaped slits. Alternatively, a various shape of slits, such as an arcuate shape, an S shape, and a crank shape may be used.

In the preceding embodiments, the side slit 41, 741 and the end slit 43, 743 reach from the end of the side wall 22 to a corner portion on a boundary between the bottom plate 21 and the side wall 22. Alternatively, the depth of the side slit 41, 741 and the end slit 43, 743 may be a depth at which the core plate 6 is able to be deformed when a great temperature difference is created between the tube 7 and the reinforce plate 9. In other words, the depth of the side slit 41, 741 and the end slit 43, 743 is a depth which enables deformation of the core plate 6.

In the preceding embodiments, a continuous rib 45, 745, 845 across the protruding portion 26 is disposed. Alternatively, a partial protruding portion may be disposed within the rib 45, 745, 845. In this case, the rib may be divided into a plurality of portions. Even in this configuration, the bottom plate 21 is still easy to be deformed at a portion where the rib is formed.

What is claimed is:

1. A heat exchanger comprising:

a core plate long and narrow in a longitudinal direction;

a plurality of tubes having ends joined to the core plate; and a reinforce plate joined to the core plate at a joined portion disposed on an end of the core plate, wherein the core plate includes:

a bottom plate where the plurality of tubes are joined;

a side wall which extends from the bottom plate and spreads along the longitudinal direction; and a side deformable portion which is formed on the side wall to extend along a height direction of the side wall from the edge of the side wall, and which is positioned within an end region between the joined portion and a first tube, and which makes deformation of the core plate possible, wherein the core plate includes:

a protruding portion formed on the bottom plate for receiving the plurality of tubes and for joining with the plurality of tubes; and a rib which is formed on the bottom plate extends across the protruding portion along a width direction of the core plate, and which is positioned within the end region between the joined portion and the first tube, and which communicates with a cavity defined above the sealing surface which contacts the seal member arranged between the core plate and a tank cover via a side opening in the width direction.

2. The heat exchanger in claim 1, wherein the side deformable portion reaches a sealing surface which contacts on a seal member arranged between the core plate and a tank cover.

3. The heat exchanger in claim 1, wherein the side deformable portion is a side slit formed by penetrating the side wall.

4. The heat exchanger in claim 1, wherein the rib has a bottom which reaches the sealing surface.

5. The heat exchanger in claim 1, wherein the side deformable portion and the rib are positioned on the same position in the longitudinal direction.

6. The heat exchanger in claim 1, wherein the core plate includes:

an end wall which extends from the bottom plate, is positioned on an end of the core plate, and is provided with the joined portion; and end deformable portions which are formed on the end wall to extend from the edge of the end wall along the height direction of the end wall beyond the joined portion at both sides of the joined portion, and which define a joining tab which extends from the bottom plate and has the joined portion, and which make deformation of the joining tab possible.

7. The heat exchanger in claim 6, wherein the end deformable portion reaches a sealing surface which contacts on a seal member arranged between the core plate and a tank cover.

8. The heat exchanger in claim 6, wherein the end deformable portion is an end slit formed by penetrating the end wall.

9. A heat exchanger comprising:

a core plate long and narrow in a longitudinal direction;

a plurality of tubes having ends joined to the core plate; and a reinforce plate joined to the core plate at a joined portion disposed on an end of the core plate, wherein the core plate includes:

a bottom plate where the plurality of tubes are joined;

a protruding portion formed on the bottom plate for receiving the plurality of tubes and for joining with the plurality of tubes; and a rib which is formed on the bottom plate to extends across the protruding portion along a width direction of the core plate, and which is positioned within the end region between the joined portion and the first tube, and which communicates with a cavity defined above a sealing surface which contacts the seal member arranged between the core plate and a tank cover via a side opening in the width direction, wherein an end wall which extends from the bottom plate, is positioned on an end of the core plate, and is provided with the joined portion; and end deformable portions which are formed on the end wall extend from the edge of the end wall along the height direction of the end wall beyond the joined portion at both sides of the joined portion, and which define a joining tab which extends from the bottom plate and has the joined portion, and which make deformation of the joining tab possible.

10. The heat exchanger in claim 9, wherein the rib has a bottom which reaches the sealing surface.

11. The heat exchanger in claim 9, wherein the end deformable portion reaches a sealing surface which contacts on a seal member arranged between the core plate and a tank cover.

12. The heat exchanger in claim 9, wherein the end deformable portion is an end slit formed by penetrating the end wall.

13. A heat exchanger comprising:

a core plate long and narrow in a longitudinal direction;

a plurality of tubes having ends joined to the core plate; and a reinforce plate joined to the core plate at a joined portion disposed on an end of the core plate, wherein the core plate includes:

a bottom plate where the plurality of tubes are joined;

an end wall which extends from the bottom plate, is positioned on an end of the core plate, and is provided with the joined portion; and end deformable portions which are formed on the end wall to extend from the edge of the end wall along the height direction of the end wall beyond the joined portion at both sides of the joined portion, and which define a joining tab which extends from the bottom plate and has the joined portion, and which make deformation of the joining tab possible.

14. The heat exchanger in claim 13, wherein the end deformable portion reaches a sealing surface which contacts on a seal member arranged between the core plate and a tank cover.

15. The heat exchanger in claim 13, wherein the end deformable portion is an end slit formed by penetrating the end wall.

16. A heat exchanger comprising:

a core plate long and narrow in a longitudinal direction;

a plurality of tubes having ends joined to the core plate; and a reinforce plate joined to the core plate at a joined portion disposed on an end of the core plate, wherein the core plate includes:

a bottom plate where the plurality of tubes are joined;

a side wall which extends from the bottom plate and spreads along the longitudinal direction; and a side deformable portion which is formed on the side wall to extend along a height direction of the side wall from the edge of the side wall, and which is positioned within an end region between the joined portion and a first tube, and which makes deformation of the core plate possible, wherein the core plate includes:

an end wall which extends from the bottom plate, is positioned on an end of the core plate, and is provided with the joined portion; and end deformable portions which are formed on the end wall extend from the edge of the end wall along the height direction of the end wall beyond the joined portion at both sides of the joined portion, and which define a joining tab which extends from the bottom plate and has the joined portion, and which make deformation of the joining tab possible.

17. The heat exchanger in claim 16, wherein the side deformable portion reaches a sealing surface which contacts on a seal member arranged between the core plate and a tank cover.

18. The heat exchanger in claim 16, wherein the side deformable portion is a side slit formed by penetrating the side wall.

19. The heat exchanger in claim 16, wherein the end deformable portion reaches a sealing surface which contacts on a seal member arranged between the core plate and a tank cover.

20. The heat exchanger in claim 16, wherein the end deformable portion is an end slit formed by penetrating the end wall.

* * * * *